US008984714B2

(12) United States Patent
Gutmark et al.

(10) Patent No.: US 8,984,714 B2
(45) Date of Patent: Mar. 24, 2015

(54) METHOD AND SYSTEMS FOR ACOUSTIC CLEANING

(75) Inventors: Ephraim Gutmark, Cincinnati, OH (US); Jeffrey Kastner, Cinicinnati, OH (US); David Michael Chapin, Cincinnati, OH (US); Terry Lewis Farmer, Raytown, MO (US); James Knox Shelton, Auburn, AL (US)

(73) Assignee: BHA Altair, LLC, Franklin, TN (US)

( * ) Notice: Subject to any disclaimer, the term of this patent is extended or adjusted under 35 U.S.C. 154(b) by 504 days.

(21) Appl. No.: 13/252,569

(22) Filed: Oct. 4, 2011
(Under 37 CFR 1.47)

(65) Prior Publication Data

US 2013/0081650 A1 Apr. 4, 2013

(51) Int. Cl.

| | |
|---|---|
| ***B08B 9/02*** | (2006.01) |
| ***A47L 9/02*** | (2006.01) |
| ***F04F 5/46*** | (2006.01) |
| ***B08B 9/00*** | (2006.01) |
| ***F23J 3/02*** | (2006.01) |
| ***F28G 7/00*** | (2006.01) |

(52) U.S. Cl.
CPC .. *F23J 3/023* (2013.01); *F28G 7/00* (2013.01)
USPC ..... 15/406; 15/405; 15/408; 15/415.1; 134/166 R; 134/170

(58) Field of Classification Search
USPC ..... 15/405, 406, 408, 415.1; 134/166 R, 134/170; 55/292
See application file for complete search history.

(56) References Cited

U.S. PATENT DOCUMENTS

| | | | | |
|---|---|---|---|---|
| 6,062,263 | A * | 5/2000 | Donovan et al. | 138/89 |
| 6,375,118 | B1 | 4/2002 | Kibens et al. | |
| 6,446,904 | B1 | 9/2002 | Stanek | |
| 6,571,549 | B1 | 6/2003 | Stanek | |
| 6,615,857 | B1 | 9/2003 | Sinha et al. | |
| 7,048,229 | B2 | 5/2006 | Sanders et al. | |
| 7,213,788 | B1 | 5/2007 | Alvi et al. | |
| 7,308,966 | B2 | 12/2007 | Gupta | |

(Continued)

OTHER PUBLICATIONS

S. Murugappan and E Gutmark, "Parametric study of the Hartmann-Sprenger tube", Experiments in Fluids, vol. 38, No. 6, pp. 813-823, Published online Apr. 26, 2005.

(Continued)

*Primary Examiner* — Eric Golightly
*Assistant Examiner* — Arlyn I Rivera-Cordero
(74) *Attorney, Agent, or Firm* — Reinhart Boerner Van Deuren P.C.

(57) ABSTRACT

A method and system for a tone generator assembly are provided. The tone generator assembly includes a resonance chamber that includes a first end and a second end and a body extending therebetween. The body surrounds a cavity therein, wherein the first end includes a resonance chamber opening in flow communication with the cavity. The tone generator assembly also includes a nozzle having a bore therethrough. The bore includes an inlet opening configured to receive a flow of relatively high pressure fluid and an outlet opening coupled in flow communication with the inlet opening and configured to discharge an underexpanded jet of fluid when the flow of relatively high pressure fluid is received at the inlet opening. The resonance chamber and the nozzle are positioned relatively and sized to facilitate emitting a tone from the tone generator assembly having a frequency less than two kilohertz.

12 Claims, 3 Drawing Sheets

(56) References Cited

U.S. PATENT DOCUMENTS 7,484,589 B2 2/2009 Guo
8,603,207 B2 * 12/2013 Zhang et al. ..... 55/292

OTHER PUBLICATIONS

S. Murugappan and E Gutmark, "Flowfield and Mixing Control of an Underexpanded Jet", AIAA Journal, vol. 42, No. 8, Aug. 2004, pp. 1612-1621.

D.A. Hutchins, H.W. Jones, and P.J. Vermeulen, "The modulated ultrasonic whistle as an acoustic source for modeling", The Journal of the Acoustical Society of America, vol. 73, No. 1, Jan. 1983, pp. 110-115.

J. Kastner and M. Samimy, "Development and Characterization of Hartmann Tube Based Fluidic Actuators for High Speed Flow Control," 40th Aerospace Sciences Meeting and Exhibit, Jan. 14-17, 2002, Reno, NV, AIAA pp. 1-15.

* cited by examiner

METHOD AND SYSTEMS FOR ACOUSTIC CLEANING

BACKGROUND OF THE INVENTION

The field of the invention relates generally to acoustic generators, and more specifically, to a method and system for generating high intensity narrow frequency band tone noise in the audible frequency range.

During operation, at least some known components of industrial processes experience deposits forming on surfaces within the component. Such deposits forming in for example, utility boilers or other industrial process components tend to adversely affect the operation of the components. Buildup on a surface of these components can cause heat transfer inefficiencies, pressure drops, excessive destructive cleaning, and excessive outage time. Removing these deposits while the process remains online facilitates an efficiency and an availability of the process.

At least some known methods of online deposit removal include shock cleaning systems, steam/air sootblowing, and acoustic horns. However, shock cleaning systems create intense sound waves through the combustion of fuel and oxidizer, which have operation costs associated with them. Steam soot blowing is expansive and erosive to surfaces being cleaned. Acoustic horns require a supply of compressed air to actuate a vibrating diaphragm plate and are known to have pressure intensity limits and wide frequency spectrum bands including frequencies that don't contribute to cleaning. The above technologies use moving parts that wear over time and must be replaced to maintain effectiveness. Such maintenance is time-consuming and disruptive to normal operations of the process.

BRIEF DESCRIPTION OF THE INVENTION

In one embodiment, a tone generator assembly includes a resonance chamber including a body having a resonance chamber opening and a resonance chamber cavity in flow communication with the resonance chamber opening. The tone generator assembly further includes a nozzle having an inlet opening configured to receive a flow of relatively high pressure fluid and an outlet opening coupled in flow communication to the inlet opening. The outlet opening is oriented in substantial axial alignment with the resonance chamber opening and spaced apart from the resonance chamber opening by a gap. The dimensions of the resonance chamber and nozzle are selected to facilitate emitting a tone having a frequency less than two kilohertz and tuned to a frequency determined to provide cleaning vibratory energy In another embodiment, a method of generating a tone includes generating a jet of fluid, directing the jet of fluid into a closed end cavity, alternately forming compressive waves and expansion waves in the cavity at a rate of less than two kilohertz using the jet of fluid, generating a tone using the compressive waves and the expansion waves, and emitting the tone towards a surface to be cleaned.

In yet another embodiment, an acoustic cleaning system includes a nozzle configured to generate an underexpanded jet of fluid and a resonance chamber configured to receive at least a portion of the jet of fluid wherein the resonance chamber includes a selectively variable length in a direction of flow of the jet of fluid. The acoustic cleaning system also includes a housing surrounding the nozzle and the resonance chamber wherein the housing includes an opening sized to emit a tone having a frequency less than one kilohertz.

Figure 1:
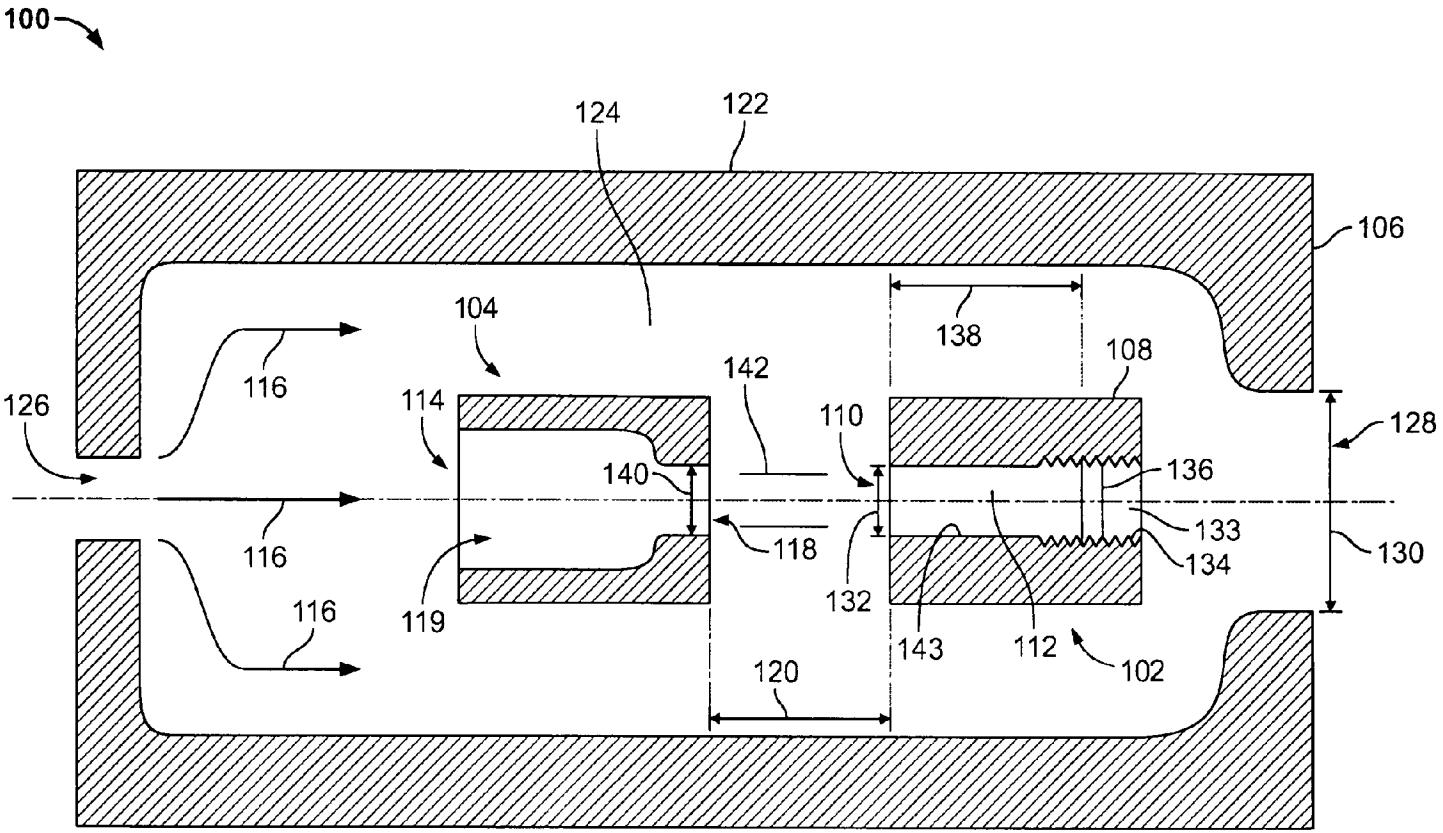
FIG. 1-3 show exemplary embodiments of the method and system described herein.
Figure 2:
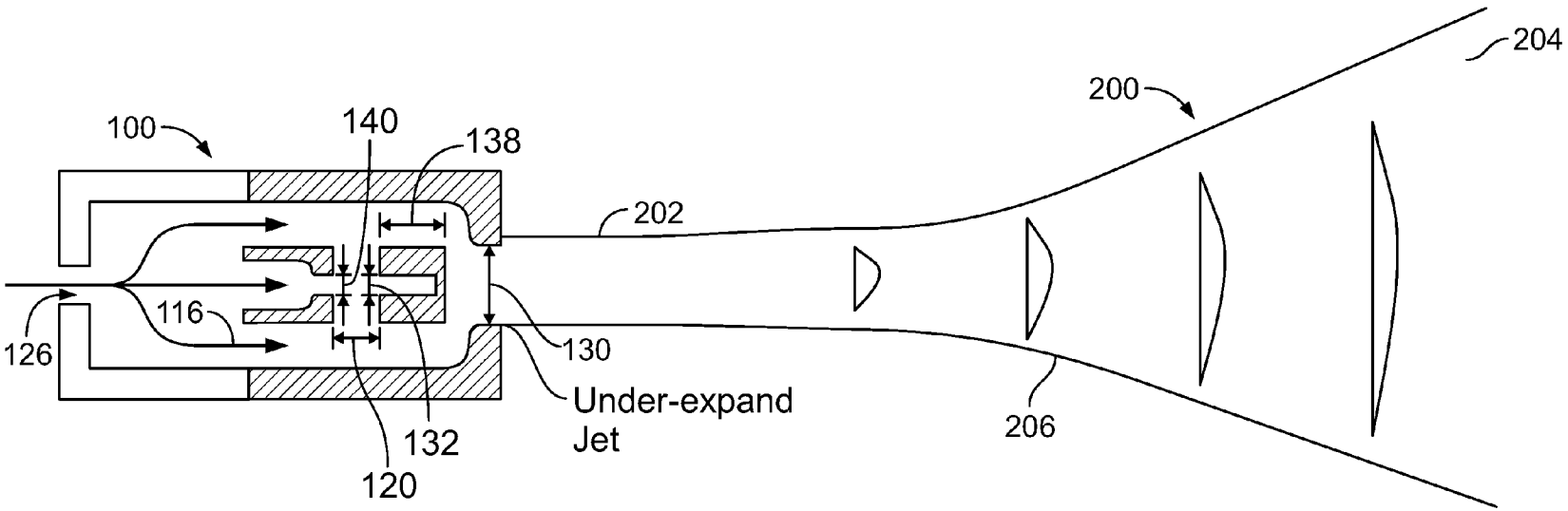
Figure 3:
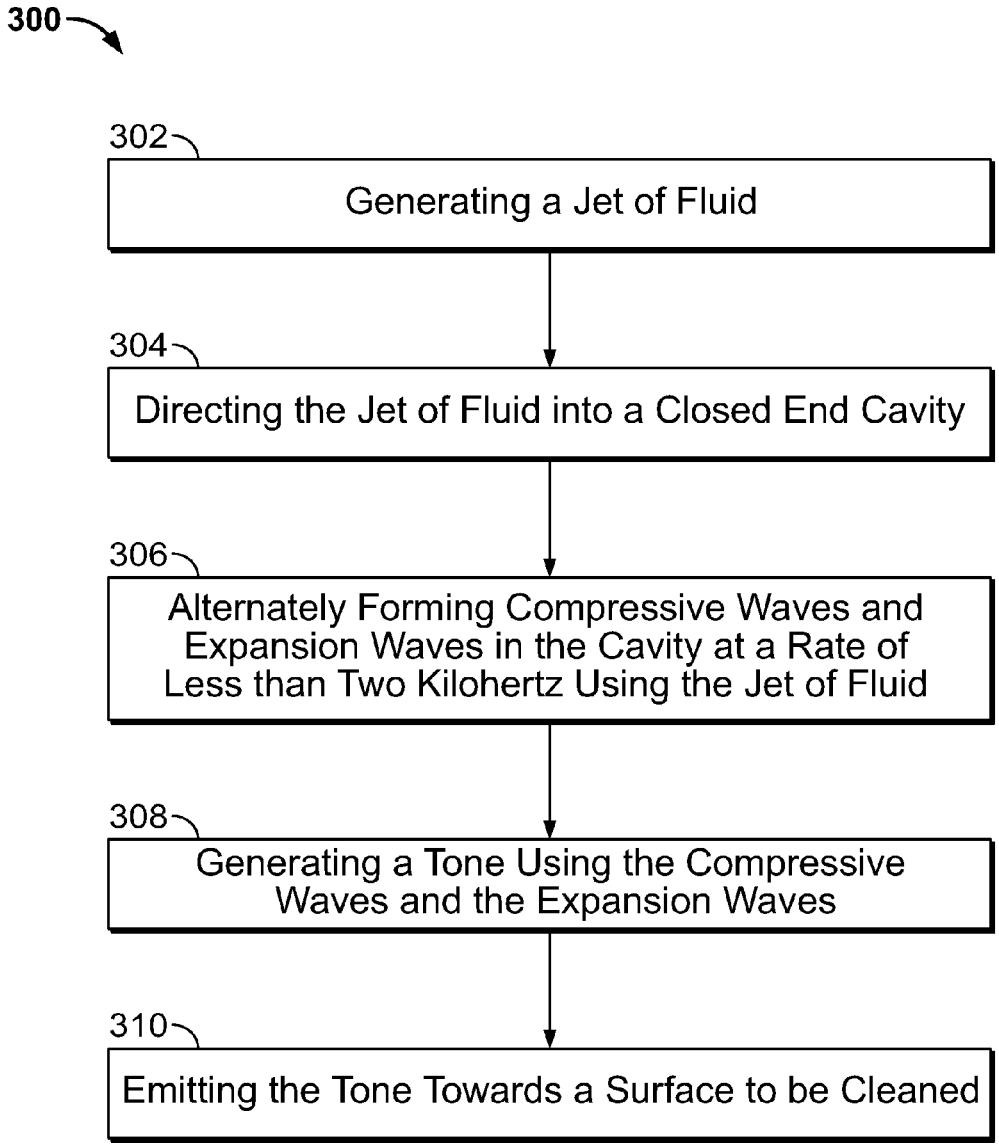

The foregoing and other features and aspects of the invention will be best understood with reference to the following description of certain exemplary embodiments of the invention, when read in conjunction with the accompanying drawings, wherein:

FIG. 1 is a schematic diagram of an acoustic cleaning tone generator assembly in accordance with an exemplary embodiment of the present invention;

FIG. 2 is a schematic diagram of the tone generator assembly shown in FIG. 1 in accordance with another embodiment of the present invention; and FIG. 3 is a flow diagram of a method of generating a tone in accordance with an exemplary embodiment of the present invention.

DETAILED DESCRIPTION OF THE INVENTION

The following detailed description illustrates embodiments of the invention by way of example and not by way of limitation. It is contemplated that the invention has general application to generating acoustic tones for cleaning components in industrial, commercial, and residential applications.

Embodiments of the present invention describe a specifically designed device configure to utilize the interaction of a high pressure jet of air and a closed-ended tube that forms a cavity, to create a high intensity, narrow frequency band tone noise. This device is designed to emit tones as sound waves in the audible frequency range. These sound waves are then used to clean surfaces in processes where debris/ash/dirt builds up causing inefficiencies in the processes. The sound waves vibrate the deposits or build up and the deposits fall from the surfaces. This is a non-destructive inexpensive cleaning technology. Instead of vibrating a diaphragm to generate noise, embodiments of the present invention operate more similarly to a whistle. By directing the jet of air into the close ended tube, compression waves are created that reflect off the back of the closed-end towards an opening of the close ended tube. The tube relieves itself of high pressure by purging fluid. The resulting expansion wave travels back to the closed-end, which reflects back to the opening as an expansion wave, letting fluid into the tube. This movement of fluid results in a high intensity tuned tone, which is utilized as the sonic driver for cleaning purposes.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

FIG. 1 is a schematic diagram of an acoustic cleaning tone generator assembly 100 in accordance with an exemplary embodiment of the present invention. In the exemplary embodiment, tone generator assembly 100 includes a resonance chamber 102, a nozzle 104, and a housing 106 surrounding resonance chamber 102 and nozzle 104. Resonance chamber 102 includes a body 108 having a resonance chamber inlet opening 110. A resonance chamber cavity 112 is in flow communication with resonance chamber opening 110.

Nozzle 104 includes an inlet opening 114 configured to receive a flow of relatively high pressure fluid 116 (e.g., compressed air) at about 50 psi-300 psi, and more preferably about 100 psi. An outlet opening 118 is coupled in flow communication to inlet opening 114 through a bore 119 therethrough that is convergent in a direction of fluid flow from inlet opening 114 to outlet opening 118. Outlet opening 118 is oriented in substantial axial alignment with resonance chamber opening 110 and spaced apart from resonance chamber opening 110 by a gap 120. Gap 120 is adjustable in an axial direction by adjusting an axial position of nozzle 104 and/or body 108.

Housing 106 includes an annular body 122 including a cavity 124 surrounding resonance chamber 102 and nozzle 104. Housing 106 includes a first opening 126 configured to receive the flow of relatively high pressure fluid 116 and a second opening 128 having a diameter 130 sized to facilitate emitting a tone having a frequency less than two kilohertz from tone generator assembly 100. Relatively lower frequency tones facilitate cleaning of industrial process components while the process is online, and provide tunability, higher dB output. Tones having a frequency greater than two kilohertz have been found to have only limited cleaning ability as compared to tones having a frequency less than two kilohertz, for example, less than 400 Hertz.

In another embodiment, bore 119 has a convergent/divergent cross-section and may include a centerbody to streamline flow through bore 119 or to facilitate matching a velocity through bore 119 to requirements for a particular application.

Resonance chamber opening 110 includes a diameter 132 sized to facilitate generating a tone having a frequency less than two kilohertz. In various embodiments, diameter 132 is sized to receive an entire flow from a jet 142 emitted from nozzle 104. In one embodiment, cavity 112 is a closed-ended cavity having a smooth wall surface 143. In another embodiment, resonance chamber 102 includes a bore 133 therethrough rather than the smooth-walled cavity 112. Bore 133 includes a threaded surface 134 that matingly engages threads on a plug 136. An axial position of plug 136 is adjustable to vary a length 138 of cavity 112. Varying length 138 by adjusting the axial position of plug 136 in bore 133 permits adjusting a pitch and/or efficiency of resonance chamber 102. Varying of diameter 132 would also have a similar effect on the pitch and/or efficiency of resonance chamber 102.

Outlet opening 118 includes a diameter 140 sized to facilitate generating underexpanded jet 142 of fluid. As used herein, underexpanded jet refers to flow through a converging nozzle where the flow velocity at the nozzle exit plane is almost sonic and is supersonic downstream of it. Underexpanded jet 142 is directed axially towards resonance chamber opening 110. Several dimensions of tone generator assembly 100 impact the pitch/efficiency of tone generator assembly 100. These dimensions include but are not limited to resonance cavity length 138, resonance cavity diameter 132, gap 120, diameter 140, and a volume of cavity 124. In addition a pressure of flow of relatively high pressure fluid 116 may also have an influence on the pitch/efficiency of tone generator assembly 100. In one embodiment, resonance cavity length 138 is approximately two times resonance cavity diameter 132.

Adjustment of the above dimensions and parameters permits a user to adjust the pitch or tone of tone generator assembly 100 and to adjust an intensity of the tone as well as an efficiency of tone generator assembly 100. For example, increasing a pressure of flow of relatively high pressure fluid 116 permits a greater intensity of the tone, however to maintain a predetermined pitch for the application others of the adjustable dimensions may also need to be adjusted. For example, diameter 140 may be increased to accommodate receiving a more powerful jet 142. The axial position of resonance chamber 102 may also be adjusted to maintain the efficiency of tone generator assembly 100 in generating the tone. Changes in other dimensions which affect the generated tone and/or efficiency of tone generator assembly 100 may need to be adjusted to compensate for the interdependence of the dimensions on tone and/or efficiency. In addition to emitting a tone having a frequency of less than two kilohertz, the dimensions of tone generator assembly 100 may be adjusted to emit a tone having a frequency between ten and one thousand Hertz and even to emit tone having a frequency between fifty and four hundred Hertz for specific applications, such as, but not limited to, cleaning components in a particulate laden gas stream.

FIG. 2 is a schematic diagram of tone generator assembly 100 (shown in FIG. 1) in accordance with another embodiment of the present invention. In the alternative embodiment, tone generator assembly 100 includes a bell 200 coupled in acoustic communication with tone generator assembly 100. Bell 200 includes a throat 202 coupled to housing 106, a mouth 204, and an acoustic horn 206 having a predetermined shape extending therebetween. In various embodiments, the predetermined shape may be but is not limited to a cone, an exponential, or a tractrix.

Bell 200 is used to increase the overall efficiency of tone generator assembly 100. Horn 206 is a passive component and does not amplify the sound from tone generator assembly 100 as such, but rather improves the coupling efficiency between tone generator assembly 100 and free air surrounding horn 206. Horn 206 provides acoustics impedance matching between tone generator assembly 100 and ambient air of low density external to mouth 204. The result is a greater acoustic output from a given tone generator assembly 100. Acoustic horn 206 converts large pressure variations with a small displacement in throat 202 into a low pressure variation with a large displacement in mouth 204 and vice versa using a gradual increase of the cross sectional area of horn 206. The small cross-sectional area of throat 202 restricts the passage of air thus presenting a high impedance to tone generator assembly 100. This allows the tone generator assembly 100 to develop a high pressure for a given displacement. Therefore the sound waves at throat 202 are of high pressure and low displacement. The tapered shape of horn 206 allows the sound waves to gradually decompress and increase in displacement until they reach mouth 204 where they are of a low pressure but large displacement.

FIG. 3 is a flow diagram of a method 300 of generating a tone in accordance with an exemplary embodiment of the present invention. In the exemplary embodiment, method 300 includes generating 302 a jet of fluid, directing 304 the jet of fluid into a closed end cavity, alternately forming 306 compressive waves and expansion waves in the cavity at a rate of less than two kilohertz using the jet of fluid, generating 308 a tone using the compressive waves and the expansion waves, and emitting 310 the tone towards a surface to be cleaned.

The device used to generate the tone includes an underexpanded jet directed into a close-ended cylindrical tube or resonance chamber of approximately equal diameter. When the cylindrical tube of the resonance chamber is placed within a compression region of the underexpanded jet, the tube begins to draw fluid in and compression waves are created at the tube entrance (the beginning of compression phase and the overall cycle) that traverse towards the closed end of the tube. The compression waves are reflected by the end wall opposite the tube entrance as compression waves, which move back toward the entrance of the tube. When these waves reach the open end, they are reflected back into the tube as expansion waves (the end of compression phase and the beginning of expansion phase). At this time, the pressure within the tube has risen above the local jet pressure. The tube, therefore, starts relieving itself of the high pressure by ejecting some of the fluid accumulated within the tube. The expansion waves traveling through the tube are reflected on the back wall as expansion waves. Once these waves reach the open end of the tube, they are reflected as compression waves (the end of the expansion phase and the cycle). Once again, the pressure in the tube is sufficiently low to allow the flow of fluid into the tube. Thus, the expansion phase and the overall cycle are complete and the compression phase of the cycle begins again. This results in the pure tone and high decibel output that is being utilized for cleaning purposes.

Because tone generator assembly 100 described in various embodiments of the present invention uses only compressed air as the operating medium, any existing acoustic cleaning system can be upgraded using tone generator assembly 100 without significant addition of infrastructure or piping. In addition, tone generator assembly 100 permits cleaning of the industrial process components while the process is online, and provide tunability, higher dB output, and a more pure tone than known acoustic cleaners.

The above-described embodiments of a method and system of a jet-cylinder interaction for production of an acoustic tone capable of efficient acoustic cleaning provide a cost-effective and reliable means for providing a more aggressive cleaning action and superior cleaning system. More specifically, the methods and system described herein facilitate operation of a tone generator assembly capable of operating at a frequency range of approximately less than 400 Hertz used for cleaning. In addition, the above-described methods and system facilitate a longer cleaner life because the cleaner has no moving parts, a higher dB output, and a purer tone. As a result, the method and system described herein facilitate generating a tone for cleaning components in industrial processes in a cost-effective and reliable manner.

This written description uses examples to disclose the invention, including the best mode, and also to enable any person skilled in the art to practice the invention, including making and using any devices or system and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A tone generator assembly comprising:

a resonance chamber comprising a first end and a second end and a body extending therebetween, said body surrounding a cavity therein, said first end comprising a resonance chamber opening in flow communication with the cavity, wherein said resonance chamber cavity comprises a bore through said resonance chamber body; and a nozzle comprising a bore therethrough, said bore comprising an inlet opening configured to receive a flow of relatively high pressure fluid and an outlet opening coupled in flow communication with said inlet opening configured to discharge an underexpanded jet of fluid when the flow of relatively high pressure fluid is received at the inlet opening, wherein said resonance chamber and said nozzle are positioned relatively and sized to facilitate emitting a tone from said tone generator assembly having a frequency less than two kilohertz and tuned to a frequency determined to provide a cleaning vibratory energy.

2. A tone generator assembly in accordance with claim 1, wherein said cavity includes dimensions including at least a length and a diameter, said resonance chamber opening includes dimensions including at least a diameter, and said nozzle outlet opening includes dimensions including at least a diameter wherein the dimensions are selected to facilitate generating a tone having a frequency of less than one kilohertz.

3. A tone generator assembly in accordance with claim 1, wherein said nozzle outlet opening is oriented in substantial axial alignment with said resonance chamber opening and said nozzle outlet opening is spaced apart from said resonance chamber opening by a predetermined gap.

4. A tone generator assembly in accordance with claim 3, wherein said gap is selectively adjustable in an axial direction.

5. A tone generator assembly in accordance with claim 1, further comprising a housing surrounding said resonance chamber and said nozzle, said housing comprising a first opening configured to receive the flow of relatively high pressure fluid, said housing comprising a second opening comprising a diameter sized to facilitate emitting the tone.

6. A tone generator assembly in accordance with claim 5, wherein said second opening comprises a diameter sized to facilitate emitting a tone having a frequency between fifty and four hundred Hertz.

7. A tone generator assembly in accordance with claim 5, further comprising a bell comprising a throat coupled to said housing, a mouth and a horn having a predetermined shape extending therebetween.

8. A tone generator assembly in accordance with claim 7, wherein said predetermined shape comprises at least one of a cone, an exponential and a tractrix.

9. A tone generator assembly in accordance with claim 1, wherein said bore is configured to receive a plug.

10. A tone generator assembly in accordance with claim 9, wherein said bore is threaded at least partially along an axial length of said bore to matingly receive a threaded plug.

11. A tone generator assembly in accordance with claim 10, wherein said threaded plug is selectively adjustable along an axial length of said bore to vary a length of said cavity.

12. A tone generator assembly in accordance with claim 10, wherein said nozzle comprises a bore therethrough convergent in a direction of fluid flow from said inlet opening to said outlet opening.

* * * * *